United States Patent [19]

Zaleski et al.

[11] Patent Number: 4,634,545

[45] Date of Patent: Jan. 6, 1987

[54] RAILROAD TRACK LUBRICANT

[75] Inventors: Peter L. Zaleski; Stanley H. Gratt, both of Chicago, Ill.

[73] Assignee: Superior Graphite Co., Chicago, Ill.

[21] Appl. No.: 709,170

[22] Filed: Mar. 7, 1985

[51] Int. Cl.[4] ..... C10M 125/02

[52] U.S. Cl. ..... 252/29; 427/369

[58] Field of Search ..... 252/29, 34, 45, 58; 427/369

[56] References Cited

U.S. PATENT DOCUMENTS

| | | | |
|---|---|---|---|
| 2,176,879 | 10/1939 | Bartell | 252/29 |
| 2,233,376 | 2/1941 | Scott | 252/29 |
| 2,242,822 | 5/1941 | Fuchs | 196/14 |
| 2,590,733 | 3/1952 | Stillman | 252/29 |
| 3,384,580 | 5/1968 | Peace | 252/29 |
| 3,438,896 | 4/1969 | Council et al. | 252/29 |
| 3,914,178 | 10/1975 | Fineran et al. | 252/29 |
| 4,094,799 | 6/1978 | DeVries et al. | 252/29 |
| 4,144,166 | 3/1979 | DeJovine | 210/60 |
| 4,203,728 | 5/1980 | Norton | 44/31 |
| 4,266,977 | 5/1981 | Steiger | 106/43 |
| 4,372,861 | 2/1983 | Chao et al. | 252/29 |
| 4,434,064 | 2/1984 | Chao et al. | 252/29 |

OTHER PUBLICATIONS

12/81—Keil, Base 380 Adhesive Specification Sheet.
10/84—Technical Data, Rapeseed Oil.
1/79—MAYCO, Base DL-33 Specification Sheet.
Paramins, Paratac Specification Sheet.
Bearing S Oil Specification Sheet.
Tufflo, Tufflo 55 Specification Sheet.
Industrial, Lubrizol 6662 Specification Sheet.
10/80—Superior, #9039—DESULCO Specification Sheet.
Superior, #9026 DESULCO Specification Sheet.
Superior, #9040 Powder DESULCO Specification Sheet.
1/85—Bearing S Oil #4555, Texaco, Oklahoma.
1/85—Tufflo 55 (or Gasson 9) from Atlantic Richfield.
1/85—Alcolec S Lecithin 4000, American Lecithin, Woodside, NY.
1/85—2600 Resin 4045, Slarvania, Memphis, TN.
Article—The American Society of Mechanical Engineers "The Consequences of Truly Effective Lubrication Upon Rail Performance".
Article—The American Society of Mechanical Engineers—"The Economics of Rail Lubrication for Energy Conservation.
Article—The American Society of Mechanical Engineers, "Freight Car Brake Shoe Performance Testing.
Article—The American Society of Mechanical Engineers, "Energy Savings Due to Wheel/Rail Lubrication–Seaboard System Test and Other Investigations".
Article—The American Society of Mechanical Engineers, "Lubrication Application System Tests at Fast".

*Primary Examiner*—William R. Dixon, Jr.
*Assistant Examiner*—Cynthia A. Prezlock
*Attorney, Agent, or Firm*—Robert M. Ward

[57] ABSTRACT

A method of lubricating a railroad track comprising the steps of dispersing together a mixture of at least 30% by weight of powdered graphite having an average particle size of not larger than 50 microns, and an oil based carrier to yield a viscosity of approximately 25,000 centipoise at standard temperature and pressure; applying said dispersion to a railroad track and pressure fixing to form a film like coating thereon.

14 Claims, No Drawings

RAILROAD TRACK LUBRICANT

BACKGROUND OF THE INVENTION

The present invention is directed to lubricants in general, and more specifically to a lubricant for disposition on a railroad track to provide greater efficiency in the railroad traffic thereover.

In the prior art, various attempts have been made to lubricate railroad tracks to reduce wear, flow and corrugation occurrence, in an attempt to reduce rail fatigue and failure. Also, attempts have been made to increase the efficiency of rail traffic over such rails.

Prior art compositions of railroad track lubricants have included various oil compositions and grease, which have had the disadvantage of hydroplaning during braking of the train. Other prior art compositions have had a tendency to pick up metal slivers in the composition matrix, which has caused premature shoe removal and wheel tread grooving. Although some efficiency increase has been effectuated in utilizing grease for a railroad track lubricant, and especially on curves, these energy savings have been offset by other disadvantages including lack of traction on sloped surfaces and a tendency of the grease product to become removed from the rail surface caused by rail wheel loading, and squeeze out.

In view of the disadvantages and deficiencies of prior art railroad track lubricants, it is a material object of the improved railroad track lubricant of the present invention to materially alleviate those difficulties and disadvantages. The accomplishment of these and other objects will be better understood in view of the following brief description of the invention, detailed description of preferred embodiments, including examples, and appended claims.

BRIEF DESCRIPTION OF THE INVENTION

The improved lubricant composition of the present invention is directed to railroad track lubricants and comprises an incompletely dispersed mixture of powdered graphite, with various oils. In alternate embodiments, various additives are included. The improved railroad track lubricant composition of the present invention is one which will "pressure fix" upon being squeezed between the railroad track and the wheel of the train traveling thereover. This phenomenon of pressure fixing occurs when the dispersed composition is applied to the railroad track, and when such composition forms a film on the railroad track caused by the extreme pressure between the railroad track wheel and the track. Although the phenomenon is not completely understood, it is believed that the extreme pressure between wheel and rail causes a more complete dispersal of the graphite within the oil-based carrier, which substantially increases the viscosity thereof to form a film.

In preferred embodiments, the powdered graphite comprises approximately 30% by weight of the composition, and has an average particle size of not larger than approximately 50 microns, with 1 to 5 microns being the preferred range. The oil-based carrier preferably includes a mixture of heavy and light oils, and is sufficient to yield an overall viscosity to the semi-dispersed composition of approximately 25,000 centipoise at standard temperature and pressure.

The above described preferred embodiments may be modified in a number of respects with relatively small proportions of various modifying agents, as are set forth more completely in the Examples as described in the following Detailed Description of Preferred Embodiments.

DETAILED DESCRIPTION OF PREFERRED EMBODIMENTS

The improved lubricant composition of the present invention for railroad track application comprises an incompletely dispersed mixture of powdered graphite in an oil-based carrier. The powdered graphite has an average particle size of not larger than approximately 50 microns. The oil-based carrier comprises oils sufficient to yield a viscosity of approximately 25,000 centipoise to the semi-dispersed composition at standard temperature and pressure. The railroad track lubricant composition of the present invention will pressure fix when squeezed at extremely high pressures between the rail and wheel of the railroad, to form a film-like coating on the railroad track.

Such preferred embodiments of the railroad track lubricant composition of the present invention contain a dispersing agent. The dispersing agent may preferably comprise a soybean lecithin which contains phosphatides in association with a carrier of fatty acid.

The improved railroad track lubricant composition of the present invention may also include one or more extreme pressure additives to supplement and improve the film-forming characteristics during pressure fixing. The extreme pressure additives may include either or both of a chlorinated fatty oil and a high sulphur oil.

A pour point depressant may also be incorporated within the composition.

The oil-based carrier of the present invention may preferably include a blend of heavy and light oils. The powdered graphite used in the improved railroad track lubricant composition of the present invention may preferably have an average particle size of approximately 1 to 5 microns.

Such powdered graphite may be present in preferred amounts of approximately 30% to approximately 40% by weight of the composition. The dispersing agent may preferably be present in amounts of approximately 0.4% to 1.0% by weight of the composition. The extreme pressure additivies may preferably comprise 0.2% to 4.0% by weight of the composition. The pour point depressant may be present in amounts of approximately 0.2% by weight of the composition.

In preferred embodiments of the railroad track lubricant composition of the present invention a tackiness agent may also be present, and in preferred amounts of approximately 1% by weight of the composition.

In preferred compositions where a blend of heavy and light oils are present, the oil may preferably be present in an amount of approximately 20% by weight of the composition, and the light oil may preferably comprise approximately 35% to 40% by weight of the composition. In such preferred embodiments, the light oil preferably comprises a low wax oil to avoid wax coming out of solution during pressure fixing.

In other preferred embodiments the oil-based carrier may comprise such low wax oil in amounts of approximately 60% by weight of the composition.

In yet other preferred embodiments the oil-based carrier may preferably comprise a bearing oil and rapeseed oil. The bearing oil may be present in an amount of approximately 50% by weight, and the rapeseed oil may be present in an amount of approximately 7% by weight of the composition. In alternative preferred embodiments, a further 7% by weight of the lubricant composition may comprise a heavy oil.

The improved railroad track lubricant composition of the present invention may be better understood upon review of the following examples in which ingredients are selected as indicated from the following trademarked products or equivalent ingredients:

| | |
|---|---|
| 2600 Resin[1] | heavy crude oil |
| Tufflo 55[2] | thin oil |
| 9040 Graphite[3] | graphite |
| Alcolec[4] | lecithin |
| Keil Base 380[5] | high sulphur oil |
| DL-33 (Mayco)[6] | chlorinated fatty oil |
| Lubrizol 6662[7] | pour point depressant |
| Bearing S Oil[8] | thin oil |
| Rapeseed Oil[9] | heavier oil |
| Paratac[10] | tackiness agent |

[1]Available from Slarvania, Memphis, Tennessee
[2]Available from Atlantic Richfield
[3]Available from Superior Graphite, Chicago, Illinois
[4]Available from American Lecithin, Woodside, New York
[5]Available from Keil Chemical Div., Hammond, Indiana
[6]Available from Mayco Oil & Chemical Co., Bristol, PA.
[7]Available from Lubrizol Corp., Wickcliffe, Ohio
[8]Available from Texaco, Oakbrook, Illinois
[9]Available from Southland Corp., Summit, Illinois
[10]Available from Exxon Chemical Corp., Houston, Texas

EXAMPLE I

| 9040 In Tufflo 55 & 2600 Resin Mix | | Ref. 89.1 |
|---|---|---|
| 2600 Resin | heavy crude oil | 19.8% |
| Tufflo 55 | thin oil | 37.6% |
| 9040 Graphite | graphite | 38.9% |
| Alcolec | lecithin | 0.7% |
| Keil Base 380 | high sulfur oil | 0.7% |
| DL-33 (Mayco) | chlorinated fatty oil | 2.1% |
| Lubrizol 6662 | pour point depressant | 0.2% |
| | | 100.0% |

The 2600 Resin and the Tufflo 55 oil were charged to the mixer along with the powdered graphite and the Alcolec lecithin dispersant. The resulting composition was mixed at moderate speed for approximately 10 minutes. Thereafter, the extreme pressure additives were added to the composition and the entire composition was further mixed for a period of 10 minutes.

The above composition was placed upon a railroad track rail, and a railroad train was run thereover. The composition pressure fixed in a satisfactory manner.

EXAMPLE II

| 9026 In AW | | Ref. 89-2 |
|---|---|---|
| Bearing S Oil | thin oil | 49.3% |
| Alcolec | lecithin | 0.4% |
| 9026 Graphite | graphite | 32.8% |
| Rapeseed Oil | heavier oil | 7.2% |
| 2600 Resin | heavy crude oil | 7.2% |
| Keil Base 380 | high sulfur oil | 0.2% |
| DL-33 (Mayco) | chlorinated fatty oil | 2.9% |
| | | 100.0% |

The above composition was prepared in the manner of example 1. The composition was tested and was found to pressure fix satisfactorily.

EXAMPLE III

| 9039 Keystone in AW | | Ref. 89-3 |
|---|---|---|
| Bearing S Oil | thin oil | 50.8% |
| Alcolec | lecithin | 0.4% |
| 9039 Keystone Graphite | graphite | 33.8% |
| Rapeseed Oil | heavier oil | 7.4% |
| 2600 Resin | heavy crude oil | 7.4% |
| Keil Base 380 | high sulfur oil | 0.2% |
| | | 100.0% |

The above composition was prepared in the manner of example 1. The composition was tested and was found to pressure fix satisfactorily.

EXAMPLE IV

| 5040 A/L in AW | | Ref. 89-5 |
|---|---|---|
| Bearing S Oil | thin oil | 50.8% |
| Alcolec | lecithin | 0.4% |
| 5040 A/L Graphite | graphite | 33.8% |
| Rapeseed Oil | heavier oil | 7.4% |
| 2600 Resin | heavy crude oil | 7.4% |
| Keil Base 380 | high sulfur oil | 0.2% |
| | | 100.0% |

The above composition was prepared in the manner of example 1. The composition was tested and was found to pressure fix satisfactorily.

EXAMPLE V

| 9039 Raymond in JL-1-44 | | Ref. 89-6 |
|---|---|---|
| Tufflo 55 | thin oil | 60.0% |
| Alcolec | lecithin | 1.0% |
| DL-33 (Mayco) | chlorinated fatty oil | 3.0% |
| Keil Base 380 | high sulfur oil | 1.0% |
| 9039 Raymond Mill | | 35.0% |
| | | 100.0% |

The above composition was prepared in the manner of example 1. The composition was tested and did not pressure fix satisfactorily.

EXAMPLE V

| 40-D Special | | |
|---|---|---|
| 40 D Suspension | | 82.4% |
| Rapeseed Oil | heavier oil | 7.2% |
| 2600 Resin | heavy crude oil | 7.2% |
| Keil Base 380 | high sulfur oil | 0.2% |
| Mayco Base DL-33 | chlorinated fatty oil | 3.0% |
| | | 100.0% |

The above composition was prepared in the manner of example 1. The composition was tested and was found to pressure fix satisfactorily.

EXAMPLE VI

| 40-D Suspension | | |
|---|---|---|
| 9040 Graphite | | 31.8% |
| Alcolec | lecithin | .5% |
| Bearing S Oil | thin oil | 50.1% |
| Rapeseed Oil | heavier oil | 7.2% |
| 2600 Resin | heavy crude oil | 7.2% |
| Keil Base 380 | high sulfur oil | 0.2% |

-continued

| 40-D Suspension | | |
|---|---|---|
| Mayco Base DL-33 | chlorinated fatty oil | 3.0% |
| | | 100.0% |

The above composition was prepared in the manner of example 1. The composition was tested and was found to pressure fix satisfactorily.

EXAMPLE VII

| JL-1-44 | | |
|---|---|---|
| Tufflo 55 | thin oil | 60.0% |
| Alcolec S | lecithin | 1.0% |
| DL-33 (Mayco Base) | chlorinated fatty oil | 3.0% |
| Keil Base 380 | high sulfur oil | 1.0% |
| 9040 Graphite | graphite | 35.0% |
| | | 100.0% |

The above composition was prepared in the manner of example 1. The composition was tested and was found to pressure fix satisfactorily.

EXAMPLE VIII

| JL-2-25 | | |
|---|---|---|
| Tufflo 55 | thin oil | 59.0% |
| Alcolec S | lecithin | 1.0% |
| DL-33 (Mayco Base) | chlorinated fatty oil | 3.0% |
| Keil Base 380 | high sulfur oil | 1.0% |
| 9040 Graphite | graphite | 35.0% |
| Paratac | tackiness agent | 1.0% |
| | | 100.0% |

The above composition was prepared in the manner of example 1. The composition was tested and was found to pressure fix satisfactorily.

Although the railroad track lubricant of the present invention has been described in terms of preferred methods and structures, it will be readily apparent to those skilled in the art that many alterations and modifications thereto may be made without departing from the invention. Accordingly, it is intended that all such modifications and alterations be included within the scope of the invention as defined by the appended claims and equivalents thereof.

What is claimed is:

1. A method of lubricating a railroad track comprising the steps of:

dispersing together a mixture of at least approximately 30% by weight of powdered graphite having an average particle size of not larger than approximately 50 microns, and an oil-based carrier, to yield a viscosity of approximately 25,000 centipoise at standard temperature and pressure;

applying such dispersion to a railroad track; and pressure fixing such dispersion upon the railroad track to form a film-like coating thereon.

2. The method of claim 1 wherein a dispersing agent is added to such mixture and such dispersing agent comprises a soybean lecithin containing phosphatides in association with a carrier of fatty acid.

3. The method of claim 1 wherein an extreme pressure additive is incorporated into the dispersion and such extreme pressure additive is selected from at least one of the group consisting of a chlorinated fatty acid and a high sulphur oil.

4. The method of claim 1 wherein such dispersion further comprises a blend of heavy and light oils.

5. The method of claim 1 wherein said powdered graphite has an average particle size of approximately 1 to approximate 5 microns.

6. The method of claim 1 wherein said powdered graphite is approximately 30% to 40% by weight of said dispersion.

7. The method of claim 2 wherein said dispersing agent comprises approximately 0.4% to 1.0% by weight of said dispersion.

8. The method of claim 3 wherein said extreme pressure additive(s) comprise 0.2% to 4.0% by weight of said dispersion.

9. The method of claim 4 wherein said heavy oil is present in an amount of approximately 20% by weight of said dispersion and said light oil is present in an amount of approximately 35%–40% by weight of said dispersion.

10. The method of claim 4 wherein said light oil comprises a low wax oil to avoid wax coming out of solution in pressure fixing.

11. The method of claim 1 wherein said oil-based carrier comprises approximately 60% by weight of a low wax oil.

12. The method of claim 1 wherein said oil-based carrier comprises a bearing oil and rapeseed oil.

13. The method of claim 12 wherein said bearing oil is approximately 50% by weight, and said rapeseed oil is approximately 7% by weight of said dispersion.

14. The method of claim 13 further comprising approximately a further 7% by weight of the lubricant composition of a heavy oil.

* * * * *